US005488345A

United States Patent [19]

Seki et al.

[11] Patent Number: 5,488,345

[45] Date of Patent: Jan. 30, 1996

[54] DISCONNECTION MECHANISM FOR A DARK CURRENT FUSE

[75] Inventors: Yoshinobu Seki; Kenichiro Kawaguchi; Gen Oozono; Akio Sugiyama; Ryuetsu Oikawa, all of Shizuoka, Japan

[73] Assignee: Yazaki Corporation, Tokyo, Japan

[21] Appl. No.: 269,674

[22] Filed: Jul. 1, 1994

[30] Foreign Application Priority Data

| | | | |
|---|---|---|---|
| Jul. 2, 1993 | [JP] | Japan | 5-164368 |
| Oct. 19, 1993 | [JP] | Japan | 5-260567 |
| Feb. 2, 1994 | [JP] | Japan | 6-010830 |

[51] Int. Cl.[6] ..... H01H 85/02; H01H 85/52; H01R 13/64; H01R 13/68

[52] U.S. Cl. ..... 337/186; 337/216; 337/198; 337/201; 337/194; 439/621; 439/250

[58] Field of Search ..... 337/186, 194, 337/198, 201, 208, 209, 210, 216, 226; 439/621, 622, 366, 250, 830, 831, 832, 833

[56] References Cited

U.S. PATENT DOCUMENTS

| | | | |
|---|---|---|---|
| 4,221,455 | 9/1980 | Cairns | 439/621 |
| 4,238,140 | 12/1980 | Cairns | 439/621 |
| 4,560,227 | 12/1985 | Bukala | 439/621 |
| 5,145,414 | 9/1992 | Oikawa | 439/621 |
| 5,171,293 | 12/1992 | Umemoto et al. | 439/622 |
| 5,215,479 | 6/1993 | Araki | 439/622 |
| 5,221,217 | 6/1993 | Oikawa | 439/621 |
| 5,224,872 | 7/1993 | Noda et al. | 439/282 |
| 5,277,626 | 1/1994 | Oikawa et al. | 439/621 |

FOREIGN PATENT DOCUMENTS

| | | | |
|---|---|---|---|
| 55-48687 | 3/1980 | Japan . | |
| 3-50739 | 5/1991 | Japan . | |
| 3-196440 | 8/1991 | Japan . | |
| 3-95578 | 9/1991 | Japan . | |
| 3-109257 | 11/1991 | Japan . | |
| 4-8352 | 1/1992 | Japan . | |
| 5-36771 | 5/1993 | Japan . | |
| 5-159693 | 6/1993 | Japan . | |
| 2218282 | 11/1989 | United Kingdom | H01H 85/20 |
| 2262667 | 6/1993 | United Kingdom | H01H 85/20 |

*Primary Examiner*—Bot L. Ledynh
*Assistant Examiner*—Stephen T. Ryan
*Attorney, Agent, or Firm*—Sughrue, Mion, Zinn, Macpeak & Seas

[57] ABSTRACT

A disconnection mechanism for a dark current fuse provides a connecting terminal connecting the dark current fuse, a fuse block body receiving the connecting terminal, and a fuse holder slidably engaged with the fuse block body in a direction of connecting the dark current fuse, the fuse holder provides a cutaway opening exposing a head of the dark current fuse being therein, an engaging projection disposed at an opening edge of the cutaway opening for engaging the head, and a supporting wall portion contacting a trunk of the dark current fuse. The disconnection mechanism is not necessary to store the extracted dark current fuse after a dark current fuse circuit is opened, so that there arises no possibility of missing the extracted dark current fuse, the dark current fuse can be extracted by using a puller, and the dark current fuse is surely held and prevented from slipping off.

4 Claims, 8 Drawing Sheets

DISCONNECTION MECHANISM FOR A DARK CURRENT FUSE

BACKGROUND OF THE INVENTION

The present invention relates to a disconnection mechanism in which a dark current fuse for electrical equipment to be directly connected to a battery of an automobile is connected or disconnected from the battery by inserting or extracting a fuse holder between the battery and the equipment, and also to a connection box having the mechanism.

FIG. 19 shows a disconnection mechanism for a dark current fuse used in a conventional connection box which is disclosed in Unexamined Japanese Utility Model Publication (Kokai) No. SHO. 62-18947.

As shown in FIG. 19, reference numerals 38 and 39 designate fuse blocks into which fuses are to be inserted and which are arranged in a connection box 40. The fuse block 38 for a dark current fuse 41 is taller than the blocks 39 for the other general fuses 42, so as to extend above the blocks 39.

The dark current fuse 41 is used for disconnecting dark current parts such as a clock which are to be directly connected to a battery, from the battery during a period between the production of the automobile and the delivery to a user. Generally, the dark current fuse 41 is extracted from the block 38 in a factory, and again inserted into the block by a dealer before the delivery to a user. In order to facilitate the extraction and insertion works, the dark current fuse 41 is made positioned higher than the other fuses.

In the conventional configuration described above, however, it is troublesome to store the dark current fuse 41 extracted from the connection box 40, and there arises a possibility of missing the extracted fuse 41. The work of extracting the dark current fuse 41 may be conducted simply surely by using a puller 22 made of a synthetic resin. Therefore, a structure of a disconnection mechanism for the dark current fuse 41 has been desired to be improved so that the dark current fuse 41 can be extracted by using the puller 22. Moreover, the structure described above has a further problem in that, when a contact pressure exerted between the dark current fuse 41 and connecting terminals (not shown) of the fuse block 38 is decreased, the fuse 41 may easily slip out of the fuse block 38.

SUMMARY OF THE INVENTION

The present invention has an object of providing a disconnection mechanism for a dark current fuse in which, after a dark current circuit is opened, it is not necessary to store an extracted dark current fuse after a dark current fuse circuit is opened, so that there arises no possibility of missing the extracted dark current fuse, the dark current fuse can be extracted by using a puller, and the dark current fuse is surely held with being prevented from slipping off. It is another object of the present invention to provide a connection box having the mechanism.

In order to attain the object, the present invention has a first aspect of a disconnection mechanism for a dark current fuse in which a fuse holder housing the dark current fuse is engaged with a body of a fuse block housing connecting terminals for the dark current fuse, the fuse holder being slidable in a direction of connecting the fuse, the fuse holder provides: a cutaway opening through which the dark current fuse is to be inserted, a head of the dark current fuse being exposed in the cutaway opening; an engaging projection which is disposed at an opening edge of the cutaway opening, and with which the head is to be engaged; and a supporting wall portion which contacts a trunk of the dark current fuse.

A second aspect of the present invention is employed in which supporting wall portion functions also as a deflection preventing plate for an engaging lance which engages with the connecting terminals in the fuse block body.

A third aspect is employed in which a pair of flexible engaging arms which oppose each other are disposed inside the fuse holder, and each of the flexible engaging arms provides an engaging projection for a head of the dark current fuse.

A fourth aspect is employed in which a pair of flexible engaging arms which oppose each other are disposed inside the fuse holder, and each of the flexible engaging arms provides an engaging projection for a head of the dark current fuse, contact projections for a fuse puller which are inclined are disposed at sides of engaging projections of the flexible engaging arms, and the contact projections are projected beyond the engaging projections.

A fifth aspect is effective to the third or fourth aspect in which ingress wall portions for arm deflection spaces between an inner side wall of the fuse holder and the flexible engaging arms are disposed in the fuse block body.

A sixth aspect is effective to the third aspect in which the engaging projections are disposed on inner side walls of the flexible engaging arms, pressing projections for the ingress wall portions are disposed on outer side walls of the flexible engaging arms, and the ingress wall portions of the fuse block body push the pressing projections in arm deflection spaces of the fuse holder, whereby the engaging projections are inclined toward the head of the fuse.

Furthermore, also a seventh aspect is employed in which a fuse guide wall having an engaging projection for a head of the dark current fuse is disposed on one inner side wall of the fuse holder, a flexible engaging arm having an engaging projection which opposes the engaging projection is disposed on another inner side wall of the fuse holder, the flexible engaging arm is elongated in a direction perpendicular to the direction of connecting the fuse, and an arm contacting plate which opposes a fuse extraction direction of the flexible engaging arm is projected.

The present invention includes also a connection box which provides one of mechanisms in the first to seventh aspects.

In the first aspect, the dark current fuse is inserted into the fuse holder via the cutaway opening, and then held under a state in which the trunk contacts the supporting wall portion and the head is engaged with the engaging projection. The held dark current fuse can easily be pulled out with nipping the head exposed in the cutaway opening by a fuse puller. In the second aspect, at the same time the fuse holder is attached, the supporting wall portion contacts the engaging lance to prevent the engaging lance from being deflected, and the connecting terminals are engaged.

In the third aspect, the head of the dark current fuse is engaged with the pair of flexible engaging arms, whereby the dark current fuse is prevented from slipping off. In the fourth aspect, when the dark current fuse is to be pulled out, the fuse puller slidingly contacts the inclined contact projections so that the flexible engaging arms are deflected outward, thereby canceling the engagement of the engaging projections with the fuse head.

In the fifth aspect, under a state in which the fuse holder is fitted onto tile fuse block body, the ingress wall portions are positioned behind the flexible engaging arms to block the deflection of the arms, thereby preventing the dark current fuse from unintentionally slipping off.

In the sixth aspect, as the attachment of the fuse holder to the fuse block body proceeds, the pressing projections of the flexible engaging arms are pushed by the ingress wall portions, and the engaging arms are deflected inward (toward the fuse) so that the engaging projections press the fuse head in the direction of connecting the fuse.

In the seventh aspect, the dark current fuse enters while deflecting the flexible engaging arm. The fuse is held between the engaging arm and the fuse guide wall by the repulsive force of the engaging arm, and prevented by the engaging projections at the both sides from moving in the direction of extracting the fuse.

In a case where one of these aspect is applied to a connection box, when the dark current circuit is closed or opened by inserting or extracting the fuse holder, the dark current fuse in the fuse holder can surely be held, thereby enabling the operation of closing or opening the dark current circuit to be surely conducted.

BRIEF DESCRIPTION OF THE DRAWINGS

In the accompanying drawings:

FIG. 1A and 1B are an exploded perspective views (temporary engaging state of a fuse holder) showing a first embodiment of the disconnection mechanism for a dark current fuse according to the present invention;

DETAILED DESCRIPTION OF THE PREFERRED EMBODIMENTS

FIGS. 1 to 4 show a first embodiment of the disconnection mechanism for a dark current fuse according to the present invention.

Figure 1A:
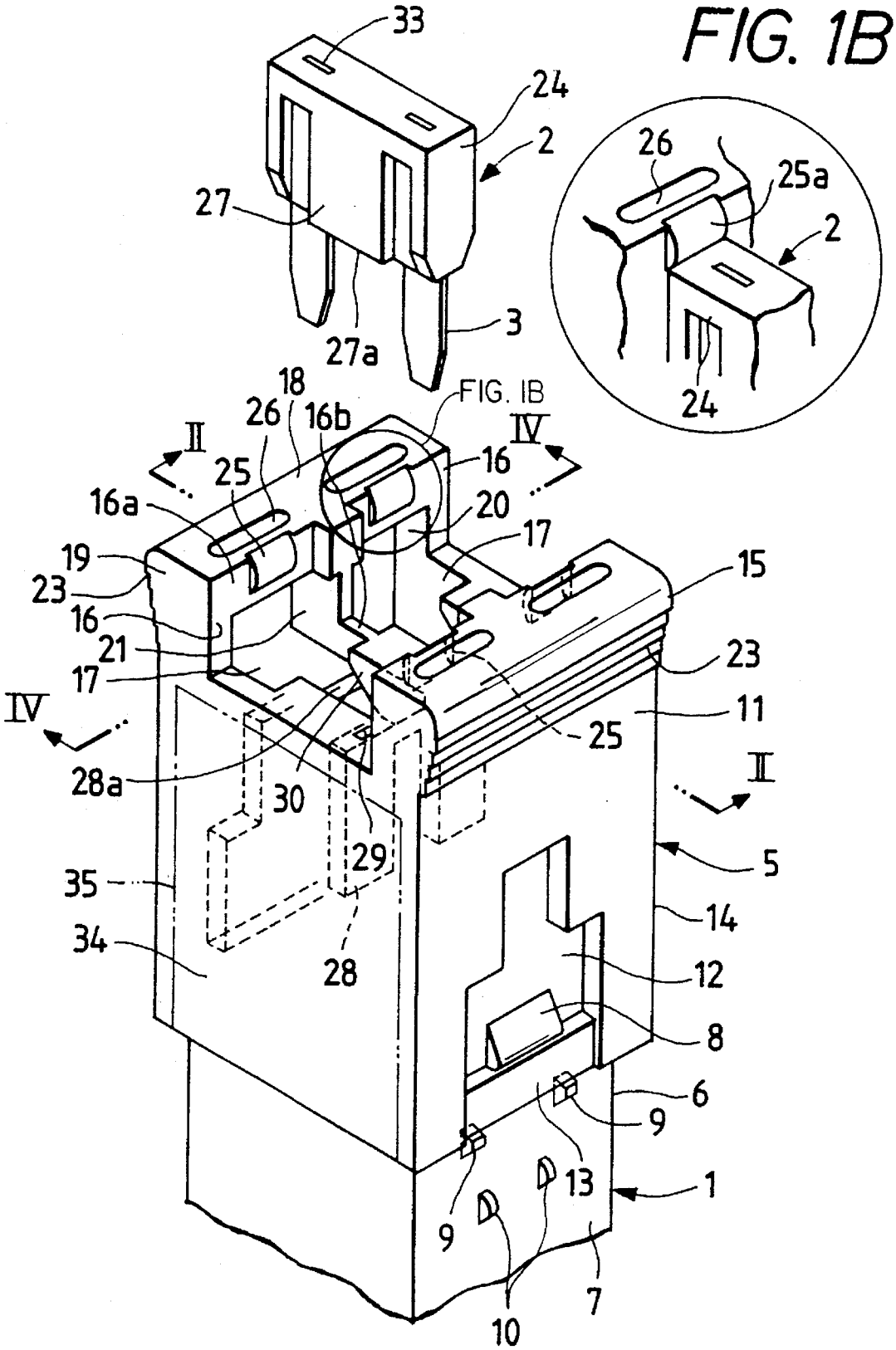

In FIG. 1, 1 designates a tower-like fuse block body which houses female connecting terminals 4 (FIG. 2) corresponding to male tab terminals 3 of a dark current fuse 2, and 5 designates a fuse holder which is made of a synthetic resin, and which is engaged with the fuse block body 1 in such a manner that the fuse holder can vertically slide over the fuse block body.

The fuse block body 1 has a rectangular cylindrical housing 6 which is made of a synthetic resin, and three sets of projections 8 to 10 which are vertically arranged on two side walls 7 of the housing. The fuse holder 5 is temporarily or permanently engaged with the projections. On each of the two side walls 7, the projections 8 to 10 are formed as follows: The upward-slip preventing single projection 8 is formed at an upper center portion of the side wall 7, to be used for a temporary engagement to prevent the fuse holder 5 from upward slipping off. A pair of the upward-slip preventing projections 10 are respectively formed at lower right and left portions of the side wall 7, to be used for a permanent engagement with the fuse holder 5 to prevent the holder from upward slipping off. A pair of the downward-slip preventing projections 9 are formed at the middle of the side wall 7 in such a manner that the distance between the projections 9 is greater than that between the projections 10. The projections 9 are used in both the temporary and permanent engagements.

Figure 19:
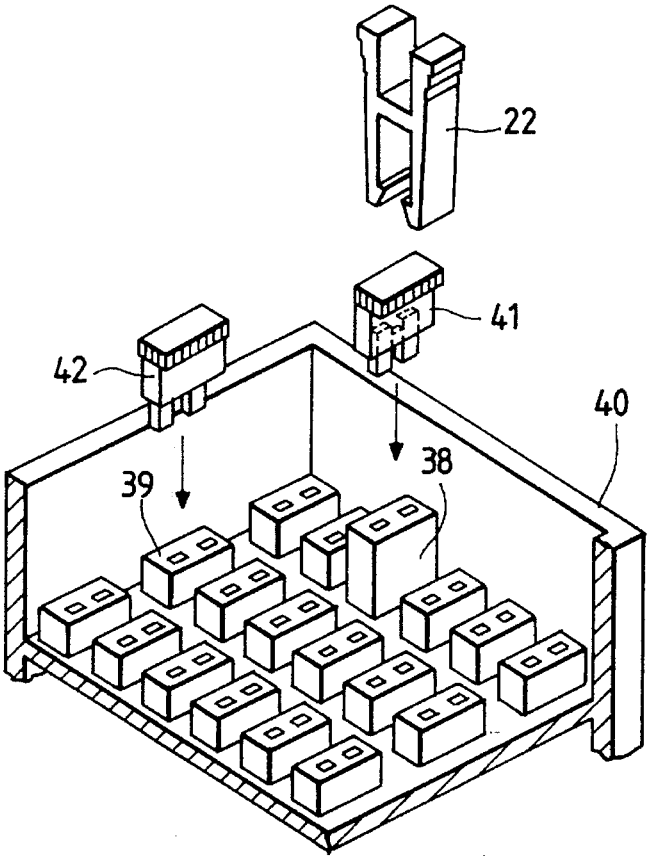
FIG. 19 PRIOR ART
FIG. 19 is an exploded perspective view showing a conventional example.

In two side walls 11 of the fuse holder 5, engaging windows 12 are respectively opened which have a shape consisting of a larger rectangle and a smaller rectangle projecting upward from the upper edge of the larger rectangle. The shape of each engaging window 12 corresponds to the projections 8 to 10. The lower edge portion of each engaging window 12 is formed as an engaging rod 13. The fuse holder 5 consists of a rectangular cylindrical lower half portion 14 in which the engaging windows 12 are formed, and an upper half portion 15 which holds the dark current fuse 2. A pair of right and left cutaway openings 16 are formed in the upper half portion 15 so that a pair of fuse housing spaces 17 are formed in the upper half portion 15. Each of the cutaway openings 16 is formed by removing portions of the upper half portion 15 which are below an upper wall 18 and between a front wall 19 or a rear wall 20 and a partition wall 21 of the fuse housing spaces 17, in such a manner that each dark current fuse 2 can be extracted by using the puller 22 which was described in conjunction with the conventional example (FIG. 19). In order to facilitate works of extracting and inserting the fuse holder 5, non-slip steps 23 for nipping are formed on upper portions of the two side walls 11.

A pair of engaging projections 25 for the head 24 of the dark current fuse 2 are formed so as to oppose each other, at an opening edge 16*a* of each cutaway opening 16 which edge is located in the side of the upper wall. In the embodiment, each engaging projection 25 has an arcuate engaging face 25*a* so that the head 24 of the dark current fuse 2 which has downward slid over the arcuate engaging face 25*a* can be engaged with the engaging projection 25. A slot 26 for deflection which pass through the upper wall 18 is formed behind each engaging projection 25, thereby providing the engaging projection 25 with flexibility. The engaging face 25*a* is not restricted to have an arcuate shape and may have another shape such as a taper-like one.

Figure 2:
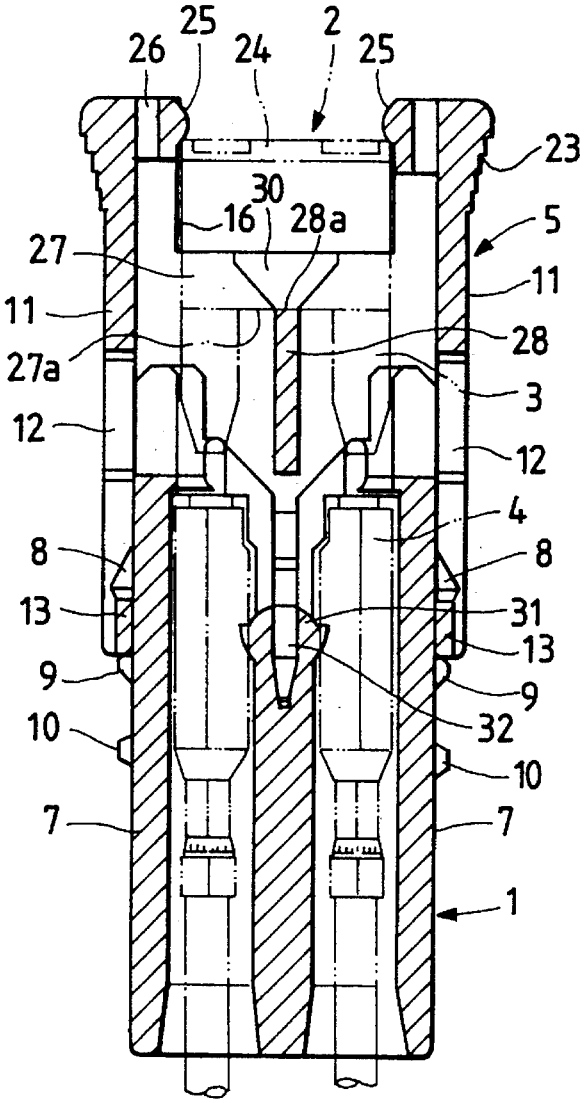
FIG. 2 is a section view along a line II—II of FIG. 1 and showing the temporary engaging state of the fuse holder.

The front and rear walls 19 and 20 of the upper half portion 15, and the partition wall 21 are connected to each other at the lower middle portion of the cutaway openings 16, by a supporting wall portion 28 for a lower end face 27*a* of the trunk 27 of the dark current fuse 2. An upper end face 28*a* of the supporting wall portion 28 is positioned so as to be lower than a lower edge 16*b* of the cutaway opening 16. The supporting wall portion 28 is connected to the front and rear walls 19 and 20, and the partition wall 21 via guide projection walls 29 and 30 for the fuse trunk 27. In the embodiment, as shown in FIG. 2, the supporting wall portion 28 functions also as a plate for preventing flexible engaging lances 31 provided in the fuse block body 1 corresponding to the female connecting terminals 4, from being deflected. More specifically, at the same time the fuse holder 5 is inserted (the permanent engagement is conducted), the supporting wall portion 28 enters inner deflection spaces 32 of the pair of engaging lances 31 as shown in FIG. 3, thereby preventing the female connecting terminals 4 from rearward slipping off.

Under the state in which the fuse holder 5 is in the temporary engaging state shown in FIGS. 1 and 2, the dark current fuse 2 is inserted into the fuse housing spaces 17 via the cutaway opening 16, so that the head 24 is engaged with the lower side of the engaging projections 25, and the lower end face 27*a* of the trunk 27 contacts the upper end 28*a* of the supporting wall 28. This temporary engaging state is obtained by putting the engaging rods 13 of the side walls 11 into the locations between the upper projections 8 and the middle projections 9, to be engaged with these projections. Under this state, the male tab terminals 3 of the dark current fuse 2 are maintained out of contact with the female connecting terminals 4.

Figure 3:
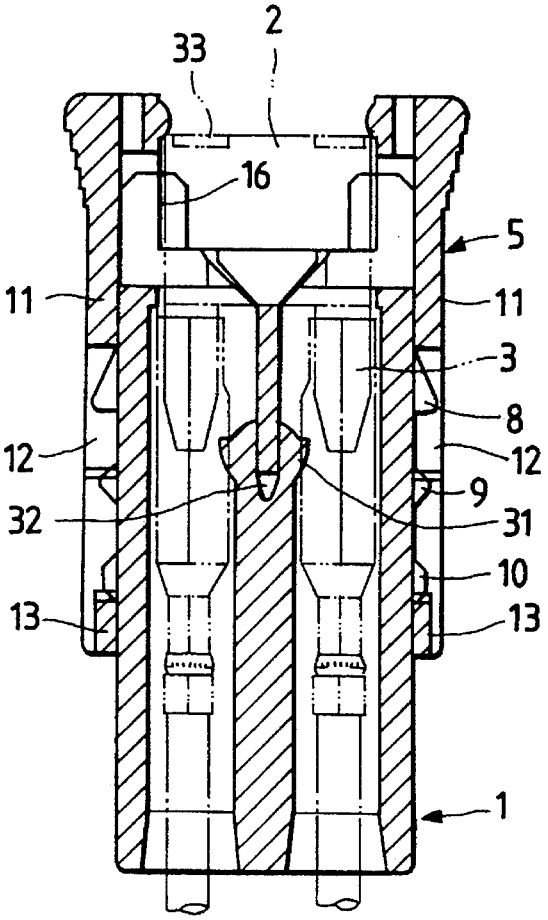
FIG. 3 is a section view showing a permanent engaging state of the fuse holder corresponding to FIG. 2.
Figure 4:
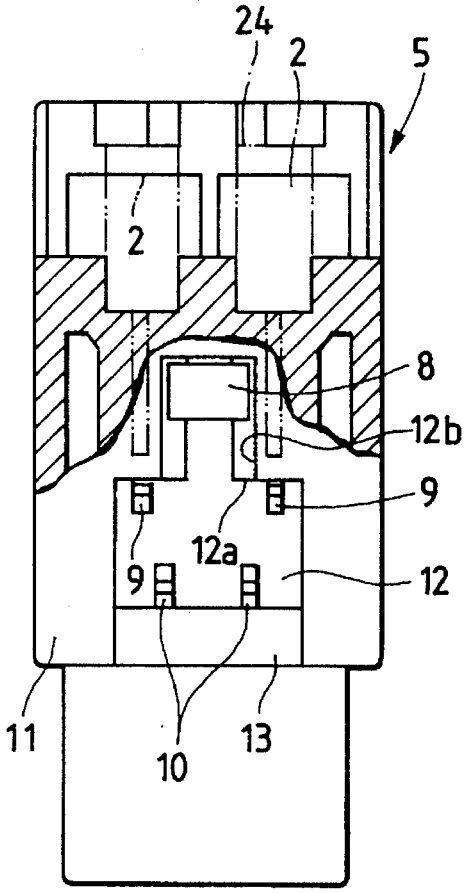
FIG. 4 is a section view corresponding to the section along a line IV—IV of FIG. 1 and showing the permanent engaging state of the fuse holder.

When the fuse holder 5 in the temporary engaging state is slid downward to enter the permanent engaging state shown in FIG. 3, the male tab terminals 3 are connected to the female connecting terminals 4, respectively. This permanent engaging state is obtained when the engaging rods 13 of the side walls 11 is moved over the lower projections 10 to be engaged therewith and intermediate step portions 12*a* of the engaging windows 12 are engaged with the upper ends of the middle projections 9. At this time, the upper projections 8 enter upper grooves 12*b* of the engaging windows 12, respectively.

Under this state, the head 24 of the dark current fuse 2 is exposed in the cutaway opening 16 of the fuse holder 5. Therefore, the burn-out of the fuse 2 can easily be confirmed by putting terminals of a circuit tester (not shown) on detection terminals 33 (FIG. 1) disposed on the head 24, and the fuse can easily be replaced with another one by using the puller 22.

Figure 5:
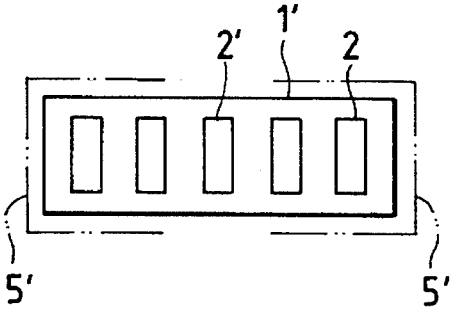
FIG. 5 is a diagram (as viewed from the above) showing a modification of the disconnection mechanism for a dark current fuse.

Alternatively, a front wall 34 may be cut away partially along a chain line 35 shown in FIG. 1 so as to form an opening of a U-like shape which is directed downward. In this alternative, as shown in FIG. 5, a fuse block body 1' which elongates laterally and into which a plurality of fuses 2' are inserted at equal intervals is passed through the opening 35 so that a fuse holder 5' is inserted to one end or the other end of the fuse block body 1'. According to this alternative, it is not required to separately prepare the fuse block body 1 for the dark current fuse 2 and other fuse block bodies for conventional fuses 2', whereby plural fuses 2' including the dark current fuse 2 are allowed to be arranged in parallel at equal intervals.

Figure 6:
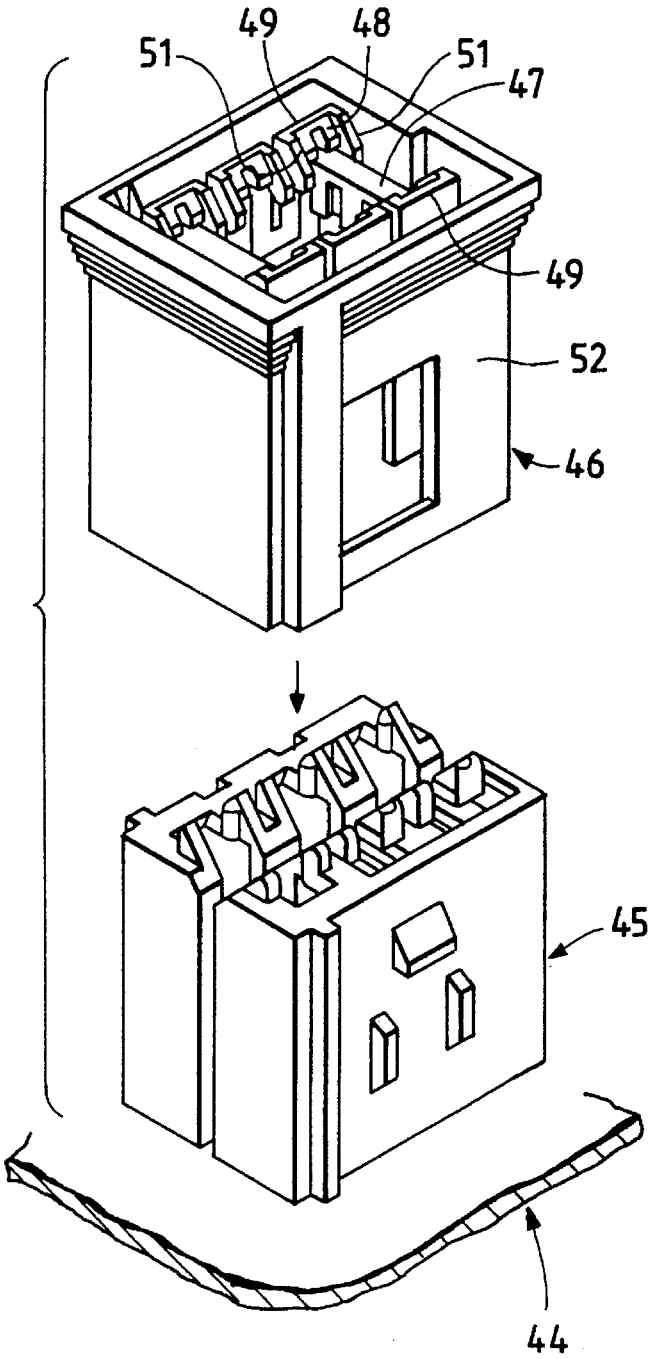
FIG. 6 is an exploded perspective view showing a second embodiment of the disconnection mechanism for a dark current fuse which is used in a connection box.
Figure 7:
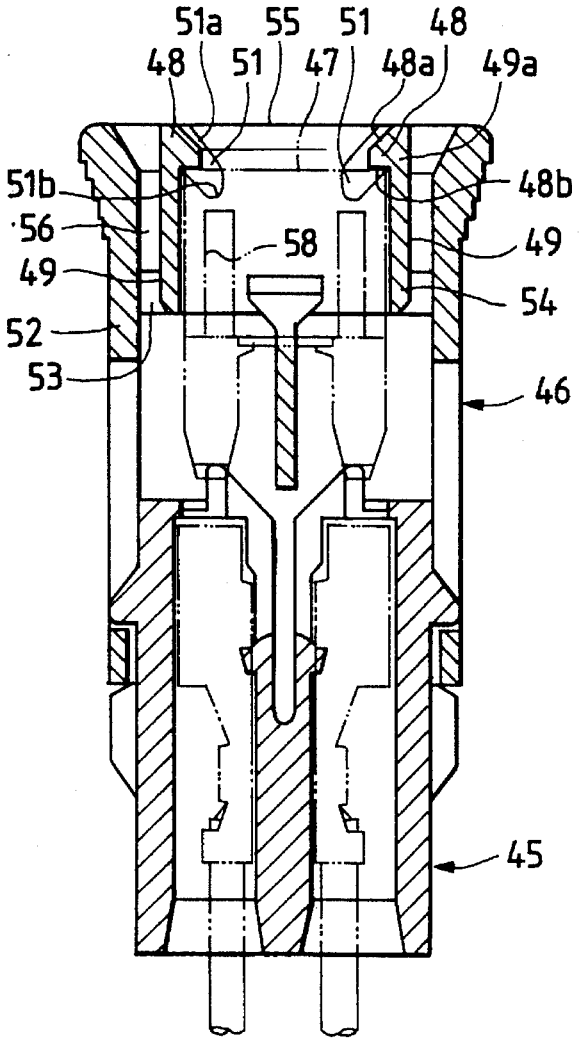
FIG. 7 is a vertical section view showing the temporary engaging state of a fuse holder.
Figure 8:
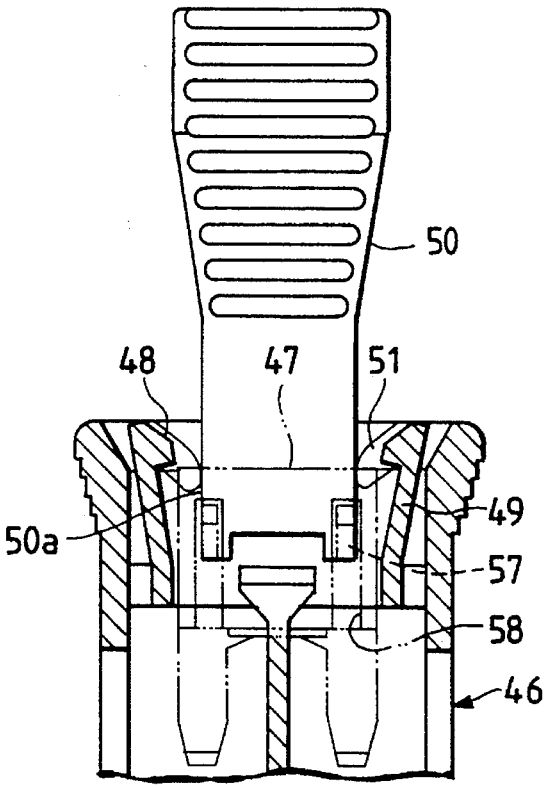
FIG. 8 is a vertical section view showing the main portion in a state in which the fuse is pulled out.

FIGS. 6 to 8 show a second embodiment of the disconnection mechanism for a dark current fuse which is used in a connection box.

This mechanism is characterized in that, in a connection box 44, a pair of flexible engaging arms 49 having an engaging projection 48 for the head of the dark current fuse 47 are disposed inside a fuse holder 46 for a fuse block body 45 which is structured in a similar manner as that of the above-described embodiment, and that each flexible engaging arm 49 is provided with a pair of inclined contact projections 51 for a fuse puller 50 which are formed at the both sides of each engaging projection 48.

The flexible engaging arms 49 are integrated with a peripheral wall (inner side wall) 52 of the fuse holder 46 via connecting pieces 53 in such a manner that the arms elongate upward from respective lower fixing portions 54 and in parallel with the inner side wall 52. In each flexible engaging arm 49, the engaging projection 48 which is directed inward, and the contact projection 51 adjacent to the engaging projection 48 are located at an arm tip 49*a* which faces an upper opening 55 of the holder 46. The engaging projection 48 has an upward-directed inclined face 48*a*, and a downward-directed horizontal face (fuse engaging face) 48*b*.

The contact projections 51 are downward inclined so as to be slightly steeper than the upward-directed inclined face 48*a*. In each of the contact projections 51, an upper inclined face 51*a* elongates downward from a position above the respective engaging projection 48, and the tip 51*b* projects largely or more inward than the respective engaging projection 48. An arm deflection space 56 is formed between each flexible engaging arm 49 and the inner side wall 52 of the holder.

FIG. 7 shows the temporary engaging state of the fuse holder 46 with respect to the fuse block body 45, or a state in which a dark current circuit of the connection box such as a fuse box, or a joint box is opened. A dark current fuse 47 is previously attached into the fuse holder 46 in such a manner that the fuse slidingly contacts the engaging projections 48 to outward deflect the flexible engaging arms 49. The head of the dark current fuse 47 is engaged with the engaging projections 48 so that the fuse 47 is held thereby with being prevented from slipping off. As shown in FIG. 6, the contact projections 51 are respectively positioned at the both sides of the dark current fuse 47 so as not to contact the fuse 47.

The fuse puller 50 is inserted into the holder 46, and claws 57 at the both sides of the puller are engaged with vertical grooves 58 which are formed below the head of the dark current fuse 47. At this time, the side portions 50*a* of the puller 50 slidingly contact the contact projections 51 to outward deflect the flexible engaging arms 49. This causes the engagement of the engaging projections 48 with the head of the fuse to be canceled, thereby allowing the fuse 47 to be easily extracted by the puller 50.

Figure 9:
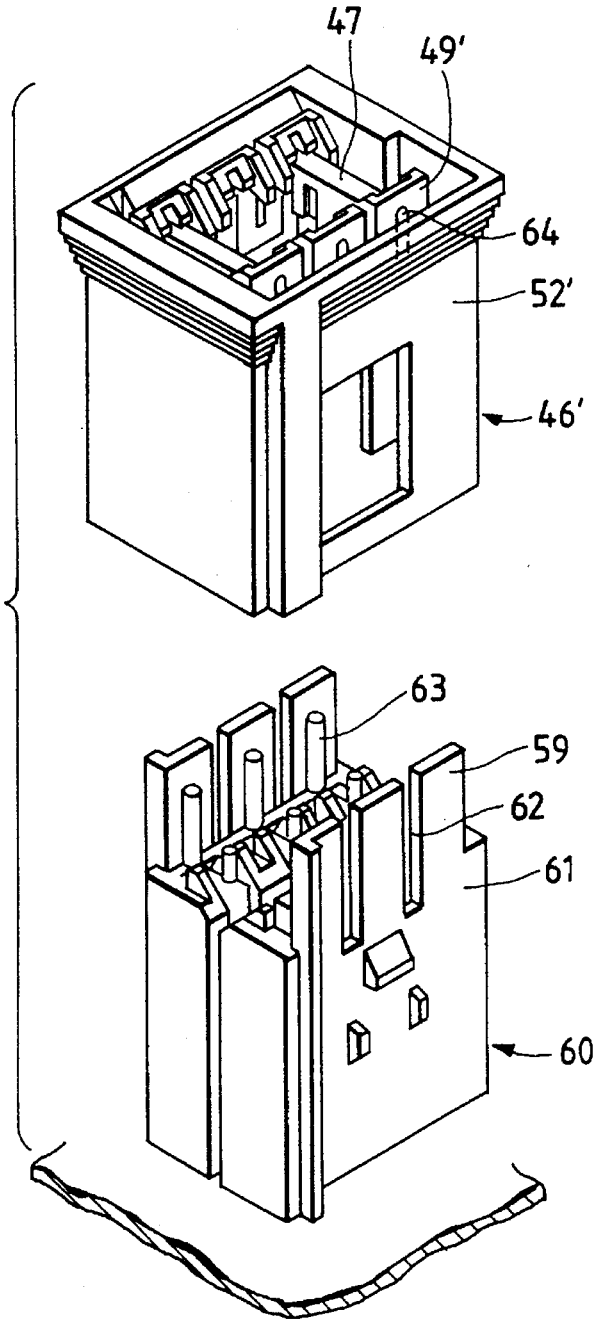
FIG. 9 is an exploded perspective view showing a third embodiment of the disconnection mechanism for a dark current fuse.
Figure 10:
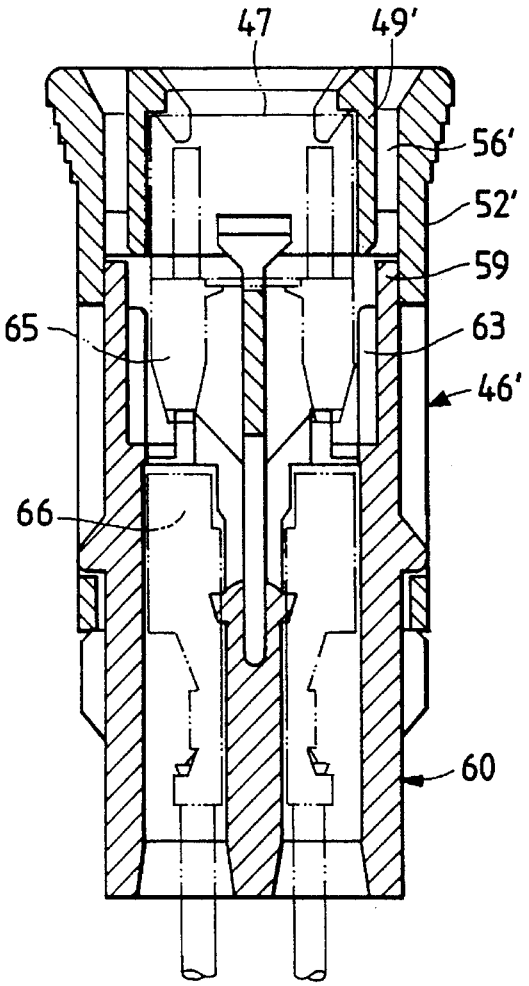
FIG. 10 is a vertical section view showing the temporary engaging state of a fuse holder.
Figure 11:
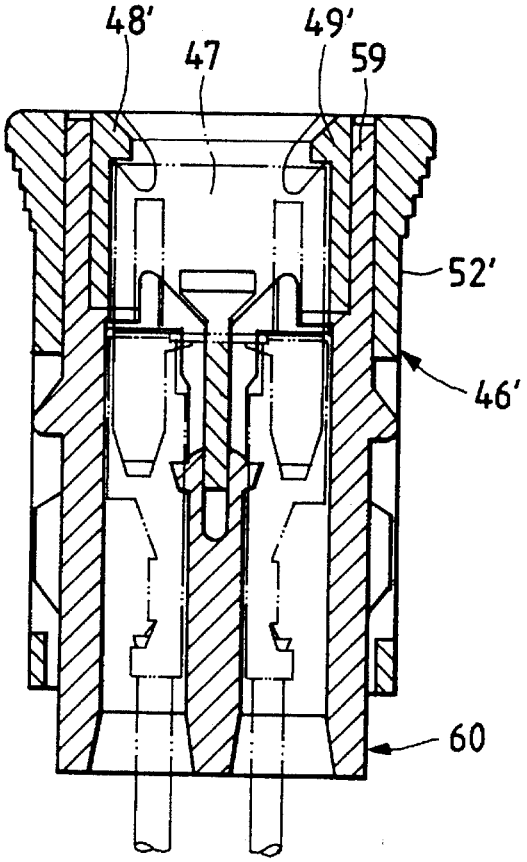
FIG. 11 is a vertical section view showing the permanent engaging state of the fuse holder.

FIGS. 9 to 11 show a third embodiment of the disconnection mechanism for a dark current fuse.

This mechanism is characterized in that plate-like ingress wall portions 59 for arm deflection spaces 56' formed between a peripheral wall (inner side wall) 52' and flexible engaging arms 49' of a fuse holder 46' which is structured in a similar manner as that of the above-described embodiment are integrally elongated from upper ends of side walls 61 of a fuse block body 60.

As shown in FIG. 9, plural pairs of the ingress wall portions 59 are juxtaposed via slits 62 so as to respectively correspond to plural pairs of the flexible engaging arms 49' in the fuse holder 46'. A vertical rib 63 is formed at the center of each ingress wall portion 59. A guide groove 64 corresponding to the vertical rib 63 is formed in each flexible engaging arm 49'.

FIG. 10 shows the temporary engaging state of the fuse holder 46' where the ingress wall portions 59 are positioned below the flexible engaging arms 49'. Under this state, a dark current fuse 47 can be attached to or detached from the fuse holder 46'. In a process of pushing down the fuse holder 46' to be permanently engaged with the fuse block body 60 as shown in FIG. 11, the ingress wall portions 59 respectively enter the arm deflection spaces 56' between the flexible engaging arms 49' and the inner side wall 52', thereby preventing the arms 49' from being deflected. Even when a force due to a sliding resistance between male tab terminals 65 of the fuse 47 and connecting terminals 66 is applied to the dark current fuse 47 in the direction pushing out the fuse in, for example, a process of attaching the fuse holder, therefore, the head of the fuse 47 is strongly pressed by engaging projections 48' of the flexible engaging arms 49' so that the fuse is surely prevented from slipping off.

Figure 12:
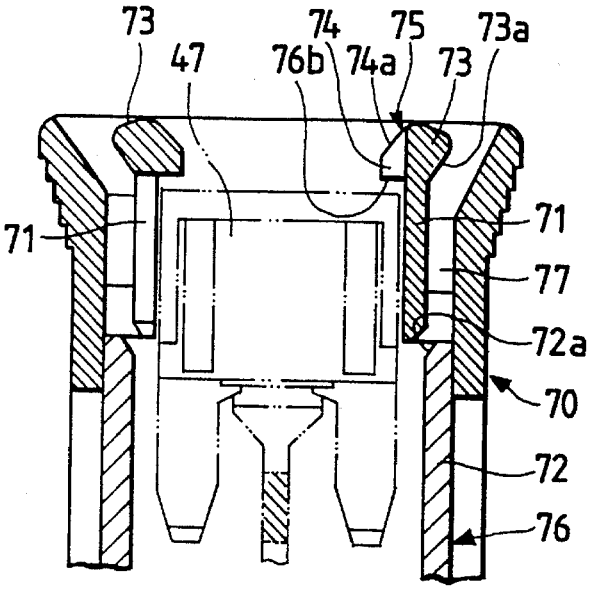
FIG. 12 is an exploded perspective view showing a fourth embodiment of the disconnection mechanism for a dark current fuse.
Figure 13:
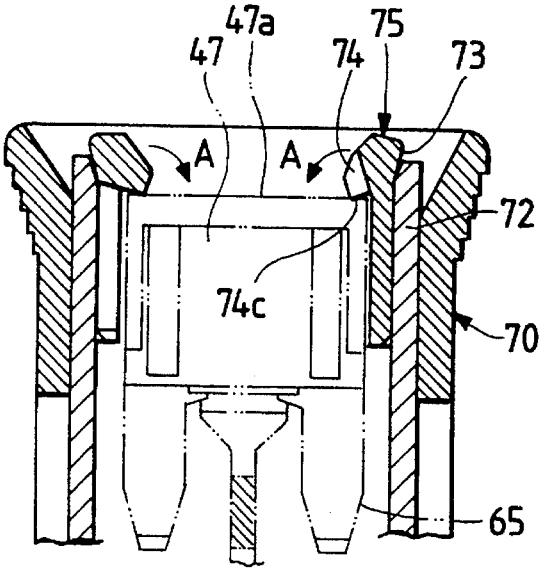
FIG. 13 is a vertical section view showing the engaging state of a fuse holder.
Figure 14:
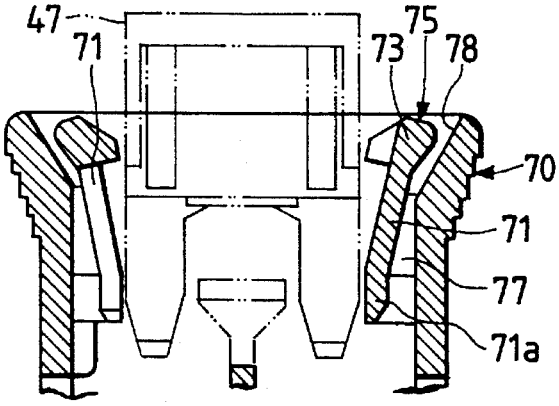
FIG. 14 is a vertical section view showing the state of attaching or detaching the fuse.
Figure 16:
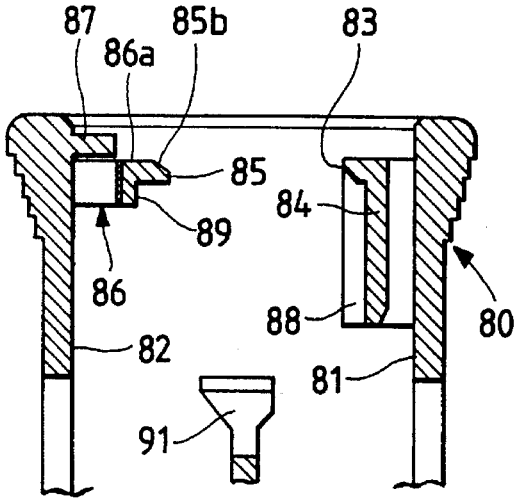
FIG. 16 is a vertical section view of the embodiment.
Figure 15:
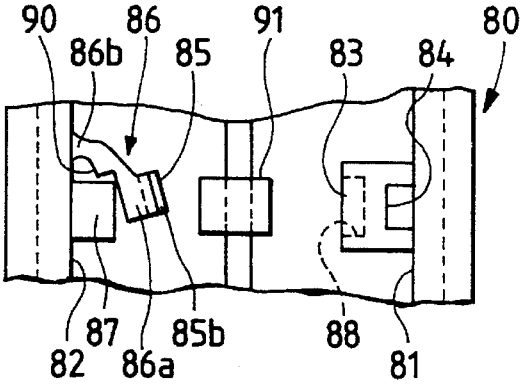
FIG. 15 is a plan view showing a fifth embodiment of the disconnection mechanism for a dark current fuse.

FIGS. 12 to 14 show a fourth embodiment of the disconnection mechanism for a dark current fuse.

In this mechanism, pressing projections 73 for ingress wall portions 72 of a fuse block body 76 which is structured in a similar manner as that of the above-described embodiment are respectively formed on the back faces (outer faces) of tip portions of a pair of flexible engaging arms 71 of a fuse holder 70 made of a synthetic resin. When the pressing projections 73 are pressed by tip portions of the ingress wall portions 72, heads 75 of the flexible engaging arms 71 are elastically bent toward engaging projections 74 which are formed on the inner face of the arm 71.

Each of the pressing projections 73 has a downward-directed inclined face **73*a* which is opposite direction to an upward-directed inclined face 74*a* of an engaging projection 74. A chamfered portion 72*a* which formed at the inner side of the tip of each ingress wall portion 72 can slidingly contact the downward-directed inclined face 73*a*. As the fuse holder 70 is pushed into the fuse block body 76 to be engaged therewith, the ingress wall portions 72 respectively enter arm deflection spaces 77 so that as shown in FIG. 13 the arm heads 75 each having the pressing projection 73 and the engaging projection 74 are pushed by the tips of the respective ingress wall portions 72 to be inclined inward as indicated by arrows A, thereby causing tips 74*c* of horizontal engaging faces 74*b* of the engaging projections 74 to be moved downward so as to press the head 47*a* of the dark current fuse 47. This allows the fuse 47 to be held without vertically rattling, and the male tab terminals 65 of the fuse 47 to be surely inserted into connecting terminals in the fuse block body 76** so as to attain connections of sufficient contact areas.

When the fuse holder 70 is pulled out upward, the arm heads 75 separate from the respective ingress wall portions 72 to return to the original shape shown in FIG. 12 (or the pressing projections 73 project outward). The dark current fuse 47 is attached to or detached from the fuse holder 70 while a pair of the flexible engaging arms 71 are deflected outward as shown in FIG. 14. Each flexible engaging arm 71 deflects in the arm deflection space 77 with using a fixed base **71*a* as a base, and each arm head 75 enters a chamfered space 78 which is formed by largely chamfering the inner peripheral edge of the upper opening of the fuse holder 70, thereby preventing the pressing projections 73** from interfering with the inner wall of the holder.

FIGS. 15 to 18 show a fifth embodiment of the disconnection mechanism for a dark current fuse.

The mechanism is characterized in that a fuse guide wall 84 elongating in the fuse insertion direction is fixed to one inner side wall 81 of a fuse holder 80 which has a substantially rectangular cylindrical shape and which is made of a synthetic resin, the fuse guide wall 84 has a flange-like engaging projection 83 for the head **47*a* of the dark current fuse 47, a flexible engaging arm 86 which has a flange-like engaging projection 85 for the fuse head 47*a* and which elongates in a horizontal direction (a direction perpendicular to the insertion of a fuse) is formed on the other inner side wall 82 which opposes the one inner side wall, and an arm contacting plate 87 is projected from the other inner side wall 82 so as to be in the vicinity of and opposed to an upper face 86*a* of the tip of the flexible engaging arm 86**.

The fuse guide wall 84 has a guide groove 88 which can house a trunk side portion **47*b* of the dark current fuse 47 and which elongates in a vertical direction (the fuse insertion direction), and an engaging projection 83 which is integrated with the guide wall and positioned above the guide groove 88**.

Figure 17:
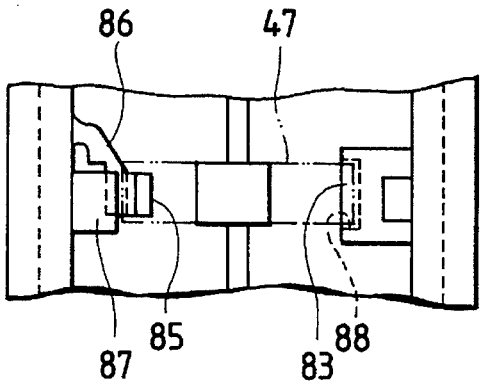
FIG. 17 is a plan view showing the engaging state of the fuse.
Figure 18:
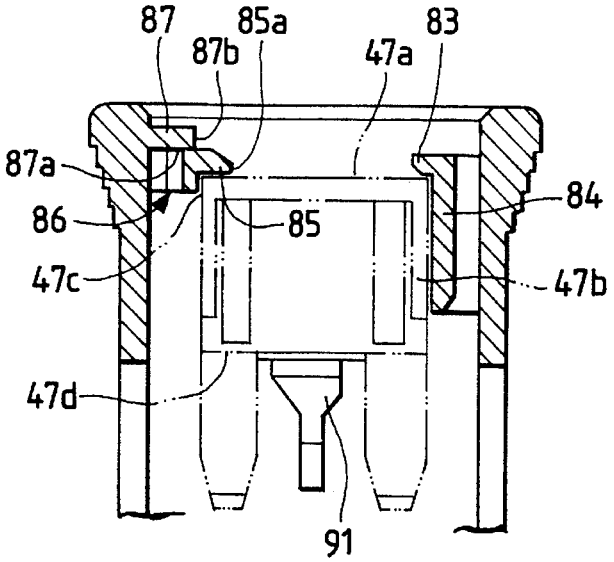
FIG. 18 is a vertical section view showing the engaging state of the fuse.

The flexible engaging arm 86 is formed into a substantially arch-like shape, has a reinforce projection 90 at the inner side of the middle portion, and exhibits a spring repulsive force toward the fuse guide wall 84. The engaging projection 85 at the tip of the arm projects so as to oppose the engaging projection 83 of the guide wall 84. The base **86*b* of the arm is located at a position on the other inner side wall 82 which portion is shifted horizontally from that of the wall opposing tile guide wall 84. The engaging projection 85 of the arm 86 projects so as to be perpendicular to an outer side face 89 of the tip of the arm 86, and contacts an upper face 47*a* of the head of the fuse. The outer side face 89 of the arm opposes the guide wall 84, and is caused by the spring repulsive force to pressingly contact a side face 47*c* of the head of the fuse. Under this state, as shown in FIGS. 17 and 18, the upper face 86*a* of the tip of the flexible engaging arm 86 contacts a lower face 87*a* of the arm contacting plate 87**.

The arm contacting plate 87 opposes the upper face **86*a* of the tip of the flexible engaging arm 86 and an upper face of the engaging projection 85, and is disposed at a position which is very close to these faces. The tip 87*b* of the arm contacting plate 87 is positioned so as not to project beyond the tip 85*a* of the engaging projection 85 of the flexible arm 86 under the engaging state of the fuse 47 (FIG. 18**).

The engaging projection 85 of the flexible arm 86 has at its tip portion an upward-directed inclined face **85*b* (FIG. 16) for the dark current fuse 47. When the dark current fuse 47 is to be inserted into the holder 80, a bottom 47*d* of the fuse slidingly contacts the upward-directed inclined face 85*b*, thereby causing the engaging arm 86 to be deflected toward the inner side wall 82. The fuse 47 passes over the engaging projection 85 so that as shown in FIG. 18 the fuse bottom 47*d* contacts a supporting wall portion 91 at the center of the holder and the fuse head 47*a* with the engaging projections 83 and 85. The engaging arm 86 collides against the arm contacting plate 87 so as to be prevented from being deflected upward, whereby the fuse 47 is held between the supporting wall portion 91 and the engaging projections 83 and 85 without rattling. Moreover, the fuse 47 is held between the engaging arm 86 and the guide wall 84** by the spring repulsive force of the arm without rattling, thereby enabling the fuse to be positioned in the width direction.

In place of the fuse guide wall 84 of the embodiment, alternatively, the flexible engaging arm 86 and the arm contacting plate 87 may be formed also on the one inner side wall 81 so that the fuse 47 is held by the pair of flexible engaging arms 86.

As described above, according to the present invention, connection and disconnection of a dark current fuse can be conducted by slidingly engaging a fuse holder with a fuse block body, and therefore the dark current fuse is not required to be extracted and stored, thereby facilitating the work. Since the fuse holder is provided with a cutaway opening for inserting a dark current fuse, furthermore, the replacement of the fuse can easily be conducted by using a fuse puller. Since the dark current fuse is stably held without rattling between an engaging projection and a supporting wall portion of the fuse holder, moreover, there is no possibility of a breakage of the fuse element due to vibration. When the supporting wall portion is structured so as to function as a deflection preventing plate for an engaging lance, attachment of the fuse holder and engagement of connecting terminals with the dark current fuse can be conducted simultaneously so that a deflection preventing plate is not required to be formed as a separate member, whereby the space inside the fuse block body can be reduced.

When the dark current fuse is engaged with a pair of flexible engaging arms, the dark current fuse is prevented from slipping off. When the flexible engaging arms are provided with inclined contact projections for the fuse puller, the flexible engaging arms are pressed by the puller so that the engagement of the flexible engaging arms is automatically canceled. This allows the fuse to be easily pulled out. When ingress wall portions for the flexible engaging arms are disposed, engagement of the engaging arms with the dark current fuse is surely conducted so that the dark current fuse is surely prevented from unintentionally slipping off at an occasion such as a process of attaching the fuse holder to the block body (i.e., a process of connecting the fuse to the connecting terminals).

When the flexible engaging arms are provided with pressing projections for the ingress wall portions, the pressing projections are pushed by the ingress wall portions, and engaging projections of the engaging arms are inclined inward so as to push the dark current fuse in the connection direction. This prevents rattling in the connection direction from occurring, and allows the contact length of the fuse and the connecting terminals in the fuse block body to be increased to a maximum degree, thereby improving the reliability of the connection.

When the dark current fuse is engaged with a flexible engaging arm elongating in a direction perpendicular to the connection direction, the fuse is prevented from rattling in the width direction, and the positioning of the fuse in the width direction is conducted, thereby attaining a sure contact of the contact terminals and the fuse. By operating only the flexible engaging arm in one side so as to be deflected, works of attaching and removing the dark current fuse are allowed to be easily conducted.

In the connection box which has one of the above-mentioned disconnection mechanisms for a dark current fuse, when works of inserting and pulling out the fuse holder are conducted, the internal circuit (dark current circuit) can correctly be closed and opened by means of the dark current fuse which is surely engaged in the holder.

What is claimed is:

1. A disconnection mechanism for a dark current fuse, comprising:

a connecting terminal connecting the dark current fuse;

a fuse block body receiving said connecting terminal;

a fuse holder slidably engaged with said fuse block body in a direction of connecting the dark current fuse; and a pair of flexible engaging arms disposed inside said fuse holder opposite to each other, each of said flexible engaging arms including an engaging projection for engaging a head of the dark current fuse, wherein said fuse block body includes an ingress wall portion for entering an arm deflection space between an inner side wall of said fuse holder and said flexible engaging arms.

2. The disconnection mechanism of claim 1, wherein each of said flexible engaging arms includes a pressing projection on an outer side wall thereof so that said ingress wall portion pushes said pressing projection in said arm deflection space for inclining said engaging projection toward the head of the fuse.

3. A disconnection mechanism for a dark current fuse, comprising:

a connecting terminal connecting the dark current fuse;

a fuse block body receiving said connecting terminal;

a fuse holder slidably engaged with said fuse block body in a direction of connecting the dark current fuse;

a pair of flexible engaging arms disposed inside said fuse holder opposite to each other, each of said flexible engaging arms including an engaging projection for engaging a head of the dark current fuse; and a pair of contact projections respectively disposed and inclined at a side of said engaging projections of said respective flexible engaging arms and being connected thereto, said contact projections projecting beyond said engaging projections, wherein a tool is insertable into said fuse holder for grasping and removing said fuse, said tool contacting said contact projections so as to deflect said contact projections and, attendantly, said engaging arms away from said fuse so that said fuse is disengaged from said fuse holder.

4. A disconnection mechanism for a dark current fuse, comprising:

a connecting terminal connecting the dark current fuse;

a fuse block body receiving said connecting terminal;

a fuse holder slidably engaged with said fuse block body in a direction of connecting the dark current fuse;

a pair of flexible engaging arms disposed inside said fuse holder opposite to each other, each of said flexible engaging arms including an engaging projection for engaging a head of the dark current fuse; and a contact projection disposed and inclined at a side of said engaging projection of said respective flexible engaging arms, said contact projection projecting beyond said engaging projection, wherein said fuse block body includes an ingress wall portion for entering an arm deflection space between an inner side wall of said fuse holder and said flexible engaging arms.

* * * * *